United States Patent [19]

Martikainen et al.

[11] 4,211,097

[45] Jul. 8, 1980

[54] CYLINDER LOCK ASSEMBLY

[75] Inventors: Jaakko Martikainen, Joensuu, Finland; Kurt Pousár, Glenview, Ill.

[73] Assignee: Ov Wartsila AB, Helsinki, Finland

[21] Appl. No.: 969,838

[22] Filed: Dec. 15, 1978

[51] Int. Cl.[2] ..... E05B 9/04

[52] U.S. Cl. ..... 70/373; 70/368; 70/379 R; 70/366

[58] Field of Search ..... 70/365, 366, 367, 368, 70/369, 370, 371, 373, 374, 379 R, 380, 372

[56] References Cited

U.S. PATENT DOCUMENTS 2,036,764 4/1936 Lowe ..... 70/369

FOREIGN PATENT DOCUMENTS 69676 12/1975 Australia ..... 70/380

226445 12/1924 United Kingdom ..... 70/373

*Primary Examiner*—Robert L. Wolfe

*Attorney, Agent, or Firm*—J. Harold Nissen

[57] ABSTRACT

A cylinder lock assembly is disclosed which comprises an outer cylinder having a front end with a key hole and a rear end with an end member. The outer cylinder encloses a rotatable inner cylinder. The end member and the outer cylinder are provided with mutually corresponding groove arrangements forming an axially fully interlocking attachment, between these two parts. The end member is insertable in a radial direction into the outer cylinder for attaching it thereto. The assembly also includes an attachment locking member engaging the outer cylinder and the end member in order to lock the end member to the outer cylinder in radial direction. The assembly can also be provided with a latch member arranged to move radially guided by the end member and the outer cylinder. The latch member may also serve as a fastening member of the assembly.

6 Claims, 5 Drawing Figures

CYLINDER LOCK ASSEMBLY

Figure 1:
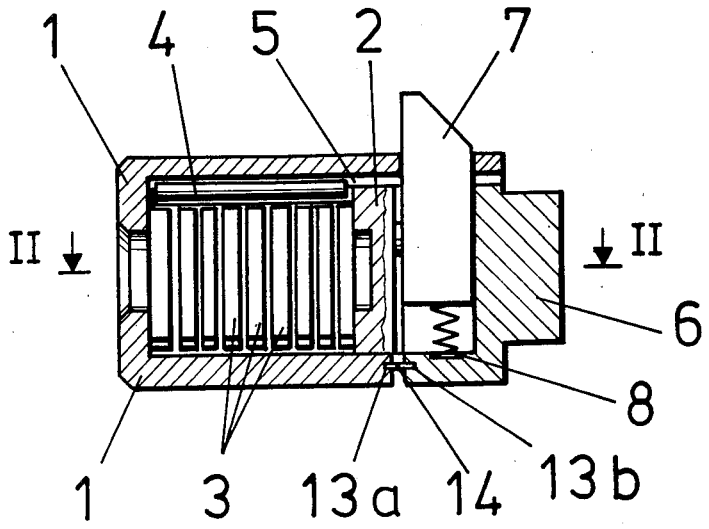

The invention relates to a cylinder lock assembly comprising an outer cylinder enclosing a rotatable inner cylinder and an end member closing, at least partly, an open rear end of the outer cylinder.

In a cylinder lock assembly of the kind referred to, the cylinder lock has a certain key combination. If unauthorized use of the lock occurs, or if the owner of the lock changes, the combination of the lock should preferably be changed. This means either the whole cylinder lock has to be replaced, which is rather expensive, or, alternatively, the combination of the cylinder lock has to be changed by replacing only some combination determining parts thereof. The latter operation is made possible by providing the outer cylinder with means allowing removal of the combination determining parts, that is, the inner cylinder with its locking elements, from the outer cylinder.

In known cylinder lock assemblies, the attachment of interior parts of the lock is often very difficult to release, which makes the changing of the lock combination so complicated that it usually is less expensive to replace the whole lock.

Another problem with known cylinder lock assemblies is the attachment of the cylinder lock into the lock mechanism of which it is a part. In many cases the attachment of the cylinder lock is so weak that it is possible to break the attachment and thus remove the cylinder lock by force.

The object of the invention is to solve the two basic problem referred to above. The invention is characterized in that the end member and the outer cylinder are provided with mutually corresponding groove arrangements forming an axially fully interlocking attachment means, and that the end member is insertable in radial direction into the outer cylinder for attaching it thereto, whereby the assembly includes an attachment locking member engaging the outer cylinder and the end member for locking the end member to the outer cylinder in a radial direction. This makes the fastening of the end member sufficiently strong to resist any possible axial load which could be applied to break up the assembly or its attachment. On the other hand, the end member can be quite easily removed, upon ordinary dismounting of the cylinder lock, to allow changing of the lock combination.

In a cylinder lock assembly according to the invention, it is of special advantage to use a disc cylinder lock of the kind originally described in U.S. Pat. No. 1,514,318. In a cylinder lock of this type, the rotatable inner cylinder encloses a number of locking discs and is locked to the outer cylinder by means of an axially extending locking bar partly received in an axial groove in the interior surface of the outer cylinder. This axial groove and the open rear end of the outer cylinder makes it possible to remove the inner cylinder, the locking bar, and the key combination determining locking discs enclosed in the inner cylinder. All these parts of the lock mechanism can be removed as one unit, which makes it very easy to change the combination in such a lock. Only the inner cylinder with its contents has to be replaced by another inner cylinder with locking discs arranged in another way. The removed inner cylinder and its contents does not have to be thrown away but can be used in another lock after suitable rearrangement of the locking discs. These operations cannot be made as easily in a pin cylinder lock, firstly, because the inner cylinder cannot be axially extracted in its locked position, because of the locking pins which are radially arranged, and secondly, because part of the pins belong to the outer cylinder and they will easily fall out and cause confusion when the inner cylinder is removed. Also other lock cylinder types are less favourable in a lock assembly according to the invention than the disc cylinder lock referred to.

The end member can easily be secured to the outer cylinder of the assembly by means of an attachment locking member, partly received by chord grooves in the end member and in the outer cylinder. These chord grooves form jointly a channel or duct, into which the attachment locking member is inserted The attachment locking member can be, for instance, a pin or a plate.

According to a preferred embodiment of the invention, the assembly is provided with a latch member operated by the inner cylinder. The latch member is arranged to move radially guided by the end member and the outer cylinder. The latch member can at a same time act as a member securing the cylinder lock assembly in its proper place and also as a latch member of a lock mechanism of which the cylinder lock assembly is a part. This simplifies the construction of the whole lock mechanism. As an example of a lock mechanism, where the invention can be used with advantage, the lock mechanism according to U.S. Pat. No. 3,213,654 can be mentioned.

A very strong latch-operating cylinder lock assembly is obtained, if the latch described above is arranged to pass through an opening in the outer cylinder so as to extend radially out from the outer cylinder outside said opening. In this embodiment the outer cylinder surrounds the latch at all sides which makes the assembly very strong, because the outer cylinder can easily be made of a material, such as steel, being capable of withstanding great stresses. The opening for the latch member is suitably located at that side of the outer cylinder, which is opposite to the side from which the end member is radially inserted into its proper place. This gives the assembly a great strength and a short over all length.

Figure 2:
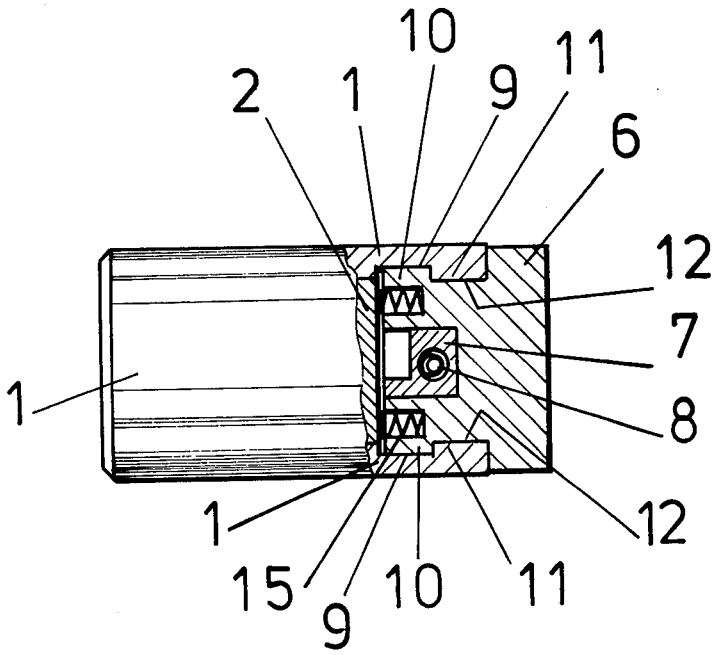
Figure 3:
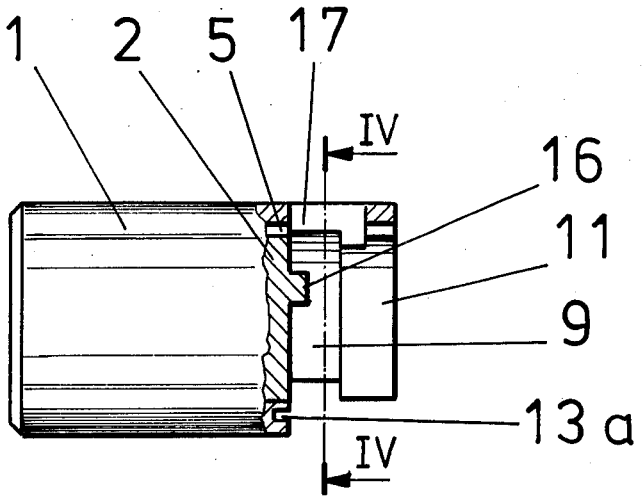
Figure 4:
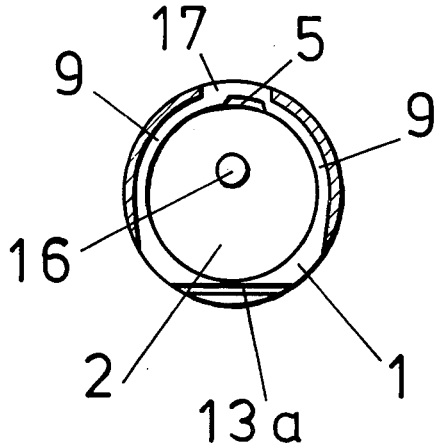
Figure 5:
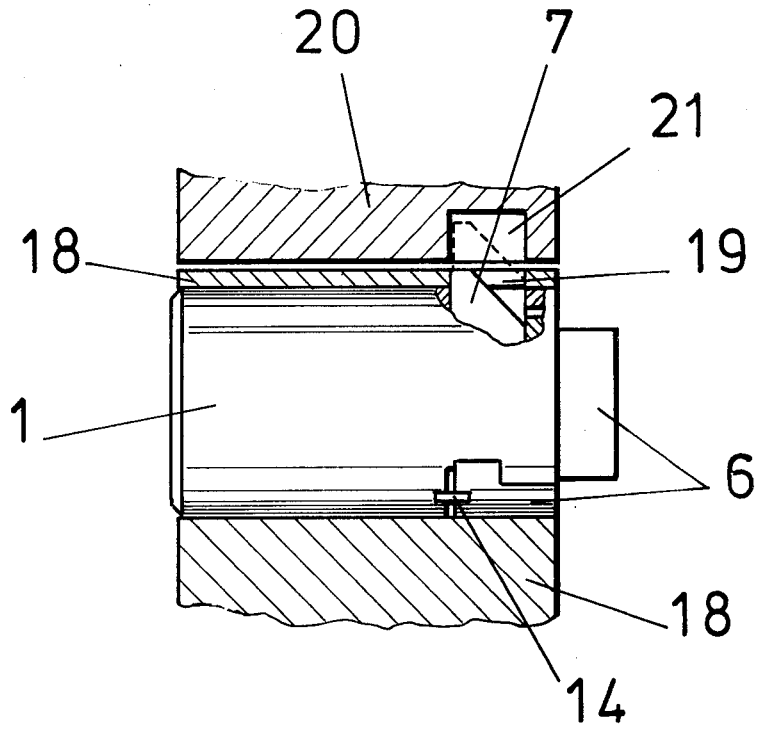

In the following, the invention will be described in greater detail with reference to the attached drawings in which FIG. 1 shows a sectional side view of a lock assembly according to the invention, FIG. 2 shows the section II—II of FIG. 1, FIG. 3 shows a side view of the outer cylinder of the lock of FIG. 1, partly in section, FIG. 4 shows the section IV—IV of FIG. 3, FIG. 5 shows a lock assembly according to the invention mounted in a unit to be locked, In the drawings, the numeral 1 indicates the outer cylinder of a cylinder lock. In this outer cylinder there is a rotatable inner cylinder 2 enclosing a plurality of locking discs 3. An axial locking bar 4 is arranged in a slot in the inner cylinder 2 between the outer cylinder 1 and the locking discs 3. The outer cylinder 1 is provided with a groove 5 partly receiving the locking bar 4 in its locking position, that is, the position in which it locks the inner cylinder 2 to the outer cylinder 1. From this locking position the locking bar 4 is movable to a releasing position out from the groove 5, and is then partly received by channel formed jointly by notches (not shown) in the peripheral edges of the locking discs 3 when they are brought to a certain position by turning the key of the lock. When the locking bar 4 is in its releasing position the inner cylinder 2 is free to rotate inside the outer cylinder 1. It is rotated by turning further the key of the lock and its rotational movement is used to operate the locking mechanism of which the cylinder lock is a part, in this case a latch 7.

The lock assembly further comprises an end member 6 radially insertable into the outer cylinder 1. The end member comprises a protrusion 10 (FIG. 2) and a groove 12 which correspond to a groove 9 and a protrusion 11, respectively, in the outer cylinder 1. This mutually corresponding groove arrangement provides an axially fully interlocking attachment of the end member 6. In the radial direction the end member 6 is locked to the outer cylinder 1 by inserting an attachment locking member 14 into a channel or duct formed jointly by grooves 13*a* and 13*b* in the end member 6 and the outer cylinder 1, respectively.

A number of springs 15 are arranged between the end member 6 and the inner cylinder 2 to allow a certain dimensional tolerance in the locking disc pile without disturbances in the function of the lock. The same effect can be obtained by using, in the conventional way axially somewhat flexible intermediate discs between the locking discs 3.

The inner cylinder 2 is provided with a peg 16 moving in a recess in the latch 7 and giving it a reciprocating movement when the inner cylinder 2 is rotated. The latch 7 is guided by the outer cylinder 1 and the end member 6 and moves in an opening 17 (FIG. 3) in the outer cylinder. Preferably a spring 8 should be used to urge the latch 7 outwards.

FIG. 5 discloses the fastening of the lock assembly by means of the latch 7. The functionally innermost position of the latch 7 is shown with full lines and its outermost position with dashed lines. The numeral 18 indicates a unit to be locked having an opening 19 through which the latch 7 can move to and from a recess 21 in a stationary element 20 to which the unit 18 can be locked. The latch 7 also keeps the cylinder lock assembly in its proper place. In order to allow the cylinder lock assembly to be properly fitted in the unit 18 the latch 7 must yield inwardly so much that it does not protrude outside the outer cylinder 1. This yielding movement is made possible by the spring 8 shown in FIG. 1 and is outside the range of the normal reciprocating movement of the latch 7 obtained by rotating the inner cylinder 2.

The invention is not limited to the embodiment shown but several modifications thereof are feasible within the scope of the attached claims.

We claim:

1. A cylinder lock assembly comprising an outer cylinder having a front end with a key hole and a rear end with an end member, said outer cylinder enclosing a rotatable inner cylinder, said end member and said outer cylinder being provided with mutually corresponding groove arrangements forming an axially fully interlocking attachment means, said end member being insertable in radial direction into said outer cylinder for attaching it thereto, said assembly including an attachment locking member engaging said outer cylinder and said end member for locking said end member to said outer cylinder in a radial direction.

2. The assembly claimed in claim 1, in which there are a plurality of locking discs enclosed in the rotatable inner cylinder and turnable with the key of the lock, and, between said outer cylinder and the peripheral edges of said locking discs, a locking bar locking said inner cylinder to said outer cylinder, which bar from a position locking the inner cylinder, in which position the bar is located partly in a groove in the inner wall of said outer cylinder, is movable to a position releasing said inner cylinder by passing into a channel formed jointly by peripheral notches in said locking discs when the discs are brought to a releasing position, said outer cylinder being formed so as to allow, upon removing said end member, axial removing of a unit including all lock combination determining parts from said outer cylinder.

3. The assembly claimed in claim 1 or 2, in which said end member and said outer cylinder are provided each with a chord groove forming jointly a channel into which said attachment locking member is inserted for locking said end member radially to said outer cylinder.

4. The assembly claimed in claim 1, in which a latch member, operated by said inner cylinder, is arranged to move radially guided by said end member and said outer cylinder, said latch member being arranged to serve as a fastening member of said cylinder lock assembly.

5. The assembly claimed in claim 4, in which said latch member passes through an opening in said outer cylinder and extends radially out from said out cylinder outside said opening.

6. The assembly claimed in claim 5, in which said opening is located opposite that side of said outer cylinder from which said end member is radially inserted into said outer cylinder.

* * * * *

UNITED STATES PATENT AND TRADEMARK OFFICE

CERTIFICATE OF CORRECTION

PATENT NO. :4,211,097

DATED : July 8, 1980

INVENTOR(S) : Jaakko Martikainen et al.

It is certified that error appears in the above—identified patent and that said Letters Patent is hereby corrected as shown below:

FOREIGN APPLICATION PRIORITY DATA

-- January 5, 1978 Canada 294,405 --.

Signed and Sealed this

Eleventh Day of November 1980

[SEAL]

Attest:

SIDNEY A. DIAMOND

Attesting Officer

Commissioner of Patents and Trademarks